US010002752B2

(12) United States Patent
Khoury

(10) Patent No.: US 10,002,752 B2
(45) Date of Patent: Jun. 19, 2018

(54) SYSTEMS AND METHODS FOR DETERMINING THE SUITABILITY OF RF SOURCES IN ULTRAVIOLET SYSTEMS

(71) Applicant: NORDSON CORPORATION, Westlake, OH (US)

(72) Inventor: James M. Khoury, Strongsville, OH (US)

(73) Assignee: NORDSON CORPORATION, Westlake, OH (US)

( * ) Notice: Subject to any disclaimer, the term of this patent is extended or adjusted under 35 U.S.C. 154(b) by 0 days. days.

(21) Appl. No.: 15/317,965

(22) PCT Filed: Jul. 6, 2015

(86) PCT No.: PCT/US2015/039211
§ 371 (c)(1),
(2) Date: Dec. 11, 2016

(87) PCT Pub. No.: WO2016/007417
PCT Pub. Date: Jan. 14, 2016

(65) Prior Publication Data

US 2017/0117131 A1 Apr. 27, 2017

Related U.S. Application Data

(60) Provisional application No. 62/021,268, filed on Jul. 7, 2014.

(51) Int. Cl.
*H05B 41/24* (2006.01)
*H01J 65/04* (2006.01)
(Continued)

(52) U.S. Cl.
CPC ..... *H01J 65/042* (2013.01); *H01J 61/52* (2013.01); *H01J 61/56* (2013.01); *H01R 4/04* (2013.01); *H01R 13/15* (2013.01); *H05B 41/36* (2013.01)

(58) Field of Classification Search
CPC .. B29C 35/08; G21K 5/00; H01J 23/34; H01J 25/00; H01J 37/32431; H01J 65/04;
(Continued)

(56) References Cited

U.S. PATENT DOCUMENTS 6,693,382 B2 2/2004 Little et al.
7,723,992 B2 5/2010 Schmitkons et al.
(Continued)

FOREIGN PATENT DOCUMENTS

CN 1744264 A 3/2006
CN 101586752 A 11/2009
(Continued)

OTHER PUBLICATIONS

Chinese Patent Application No. 201580037019.6: First Office Action dated Jun. 28, 2017, 13 pages.

*Primary Examiner* — Kretelia Graham
*Assistant Examiner* — Henry Luong
(74) *Attorney, Agent, or Firm* — Baker & Hostetler LLP

(57) ABSTRACT

A UV system for irradiating a substrate includes a RF source capable of generating RF energy, a UV lamp capable of emitting UV energy when excited by the RF energy generated by the RF source, and a monitor coupled to the RF source. The monitor includes data relating to the RF source. The UV system further includes a controller capable of communication with the monitor, and the controller determines if the RF source is suitable for operation with the UV system based on the data of the monitor and/or the end of its useful life.

24 Claims, 7 Drawing Sheets

(51) Int. Cl.

| | |
|---|---|
| ***H01J 61/52*** | (2006.01) |
| ***H01J 61/56*** | (2006.01) |
| ***H05B 41/36*** | (2006.01) |
| ***H01R 13/15*** | (2006.01) |
| ***H01R 4/04*** | (2006.01) |

(58) Field of Classification Search
CPC ..... H01J 65/042; H01J 65/044; H01J 65/06; H01J 2225/50; H01J 21/67115; H05B 6/00; H05B 6/04; H05B 33/00; H05B 33/12; H05B 37/00; H05B 37/02; H05B 41/00; H05B 41/06; H05B 41/08; H05B 41/10; H05B 41/14; H05B 41/24
See application file for complete search history.

(56) References Cited

U.S. PATENT DOCUMENTS

| | | | | |
|---|---|---|---|---|
| 7,863,834 | B2 * | 1/2011 | Bretmersky ..... | H05B 41/2806 315/248 |
| 2002/0050575 | A1 | 5/2002 | Keogh et al. | |
| 2002/0135321 | A1 | 9/2002 | Barry et al. | |
| 2006/0049766 | A1 | 3/2006 | Lee et al. | |
| 2009/0001990 | A1 * | 1/2009 | Schmitkons ..... | H05B 41/24 324/414 |
| 2009/0160345 | A1 * | 6/2009 | Bretmersky ..... | H01J 23/34 315/160 |
| 2009/0195160 | A1 | 8/2009 | Shinogi | |
| 2009/0289582 | A1 | 11/2009 | Armitage et al. | |
| 2011/0284528 | A1 * | 11/2011 | Kanzaki ..... | H05B 6/666 219/710 |
| 2013/0093322 | A1 | 4/2013 | Borsuk et al. | |
| 2013/0122611 | A1 | 5/2013 | Yang et al. | |
| 2014/0138550 | A1 * | 5/2014 | Yang ..... | B05D 3/067 250/370.08 |

FOREIGN PATENT DOCUMENTS

| | | | |
|---|---|---|---|
| CN | 102568229 | A | 7/2012 |
| CN | 203243586 | U | 10/2013 |
| EP | 1641018 | A1 | 3/2006 |
| EP | 2469498 | A2 | 6/2012 |

* cited by examiner

SYSTEMS AND METHODS FOR DETERMINING THE SUITABILITY OF RF SOURCES IN ULTRAVIOLET SYSTEMS

CROSS-REFERENCE TO RELATED APPLICATIONS

This application is a U.S. National Stage of International Patent App. No. PCT/US2015/039211, filed Jul. 6, 2015, which claims priority to U.S. Provisional App. No. 62/021,268, filed Jul. 7, 2014, the disclosures of which are incorporated by reference in their entirety.

TECHNICAL FIELD

The present invention generally relates to ultraviolet ("UV") systems for irradiating a substrate and, more particularly, to determining the suitability of RF sources used in such systems.

BACKGROUND

Conventional UV systems include one or more magnetrons and a UV bulb enclosed in a lamphead. The UV bulb is mounted within a metallic microwave cavity or chamber, and the magnetrons are coupled to the interior of the microwave chamber by one or more waveguides. Upon the application of power, the magnetrons generate radio frequency ("RF") energy into the microwave chamber through the waveguides. The RF energy excites and ignites a gas inside the UV bulb in the microwave chamber, thereby causing the gas to enter into a plasma state. As a result, the UV bulb begins to emit UV energy, which can be used for a number of applications. For example, the UV energy can be directed to a substrate for the purpose of curing materials thereon or modifying the surface thereof.

The magnetrons used in conventional UV systems are consumable items with their life determined by a number of factors, including total hours of operation, operating temperature, as well as other conditions. When a magnetron reaches the end of its life, the magnetron becomes unsuitable for use and necessary to replace. However, conventional UV systems contain certain drawbacks relative to the determination of when to replace the magnetron, and whether the replacement magnetron will be suitable for use with the UV system.

For example, operating a magnetron at higher temperatures than its rated temperature has been found to play a major role in reducing magnetron life. Conventional lampheads incorporate remote sensing devices within the lamphead for inferring the temperature of the magnetrons. Due to variations and lag caused by air flow and heat transfer in the lamphead, however, these remote sensing devices can offer inaccurate and delayed readings with respect to the operating temperature of the magnetron. As a result, conventional UV systems may fail to provide an accurate prediction of magnetron life based on the operating temperatures of the magnetron. This lack of an accurate prediction of magnetron life can cause a user to replace a magnetron earlier than is necessary, or conversely to not replace the magnetron until after it has failed. Because the downtime from replacing magnetrons can be expensive, users often opt to implement overly aggressive maintenance schedules to replace magnetrons before they fail. But aggressive replacement schedules result in added cost.

Conventional UV systems also fail to monitor for magnetron incompatibility. The intensity of the UV energy emitted from a UV system largely depends on the magnitude of the RF energy supplied by the magnetrons. To that end, conventional UV systems require high powered magnetrons having stringent specifications. Once an original manufacturer's magnetron is ready to be replaced, however, some users may replace the magnetron with one that does not meet the required specifications. Such replacements may reduce the effectiveness of the UV system or have other negative consequences.

For example, typical high volume UV systems incorporate two high powered magnetrons that supply RF energy at specific frequencies differing by 20 MHz. The 20 MHz difference is enough to prevent spectral interference between the magnetrons during operation while also optimizing the UV energy output relative to intensity and spectral output. A greater difference would adversely affect the excitement and ignition of the UV bulb, leading to longer start times and reduced emission of UV energy. Furthermore, because each waveguide that couples the magnetron to the UV bulb has geometry directly proportional to the frequency of the coupled magnetron, using a magnetron with an incompatible frequency results in reduced RF coupling with the UV bulb. Thus, using a replacement magnetron emitting an RF frequency that is too close to that of another magnetron in the same UV system may result in spectral interference and even damage. On the other hand, using a replacement magnetron emitting an RF frequency that is too distant from the RF frequency of another magnetron in that system may result in unacceptable levels or uniformity of UV output.

Other factors also affect the compatibility of a replacement magnetron with a UV system. For example, each magnetron includes a filament of a certain size and shape that is used to generate free electrons and thereby initiate the creation of the RF energy. However, improper filament size and shape for a given UV system can prevent the magnetron from starting properly or lead to magnetron damage. Furthermore, some magnetrons are simply of lesser quality and have a shorter effective life, which results in more frequent magnetron replacement. In addition, replacement magnetrons must also be compatible with the power supply of the UV system to function properly.

More recently, UV systems have been developed which use an alternative, solid state circuit to generate the necessary RF energy, which has potential advantages in manufacturing cost, durability, and other performance metrics. However, some of the concerns noted above which are applicable to magnetron RF sources are also applicable to solid state sources, such as the necessity to determine whether the solid state RF source has reached the end of it useful life, whether the solid state source is being used at an appropriate temperature and other appropriate environmental conditions and how those might effect useful life, and the need to ensure that a solid state RF source is compatible with the UV system in which it is being installed and meets the appropriate specifications for the installation environment.

For these reasons, as well as others, it is desirable to provide improved UV systems and methods for ensuring that a RF source of a UV system is suitable for use with that system.

SUMMARY

A UV system for irradiating a substrate includes a RF source, which may be a magnetron or solid state source, or other RF source capable of generating RF energy, a UV lamp capable of emitting UV energy when excited by the RF energy generated by the magnetron, and a monitor coupled to the magnetron. The monitor includes data relating to the RF source. Furthermore, the UV system includes a controller capable of communicating with the monitor.

In one aspect, the inclusion of the monitor and communication with the controller permits a validation process, wherein the controller determines whether the RF source is suitable for operation with the UV system based on the data of the monitor, which prevents use of an inappropriate RF source in the UV system with the attended performance degradation and potential damage.

In some embodiments, the data of the monitor includes an identification code specific to the RF source, and the controller determines whether the RF source is suitable for operation with the UV system by determining if the RF source is compatible with the UV system based on the identification code in the data of the monitor. In addition or alternatively, the monitor may be rigidly coupled to the RF source by a connector. As used herein, rigidly coupled means that the connector is not easily removable from the RF source without damaging the connector and/or the monitor. In addition or alternatively, the RF source may include a heat sink with a fin, and the monitor may be coupled to the fin of the RF source by the connector.

In another aspect, the inclusion of the monitor and communication with the controller permits management of the life cycle of the RF source, wherein the controller UV system also includes an operating time database coupled with the controller, and the controller is capable of storing a running total of actual operating time of the RF source in the database. Thus, the controller may be capable of predicting a remaining life of the RF source based on the running total of actual operating time of the RF source stored in the database.

In the disclosed embodiment, the controller includes an operating time database which is updated during use of the RF source. In some embodiments, the monitor is capable of storing a running total of actual operating time of the RF source in the data of the monitor, and the controller is capable of predicting a remaining life of the RF source based on the running total of actual operating time of the RF source included in the data of the monitor. Additionally, the controller may be configured to determine that the RF source is not suitable for operation with the UV system if the controller predicts that the RF source has no life remaining.

In some embodiments, the data of the monitor includes an operating temperature of the RF source, and the controller determines whether the RF source is suitable for operation with the UV system based on the operating temperature included in the data of the monitor. Additionally, the controller may be configured to determine that the RF source is not suitable for operation with the UV system if the operating temperature exceeds a set maximum operating temperature.

A method for determining whether a RF source is suitable for use in a UV system used for irradiating a substrate includes communicating data relating to the RF source from a monitor coupled to the RF source and to a controller. The method further includes determining, with the controller, if the RF source is suitable for use with the UV system based on the data, and generating an error signal with the controller if the RF source is not suitable for use with the UV system.

In some embodiments, the data relating to the RF source includes an identification code of the RF source, and determining if the RF source is suitable for use with the UV system based on the data includes determining if the RF source is compatible with the UV system based on the identification code. Additionally or alternatively, the method may include transmitting the error signal to a controller/power supply to prevent the RF source from operating and/or to a user interface to display an error message.

In some embodiments, the data relating to the RF source includes an operating temperature of the RF source, and determining if the RF source is suitable for use with the UV system based on the data includes determining that the RF source is not suitable for use with the UV system if the operating temperature of the RF source is greater than a set maximum operating temperature.

A method for management of the life cycle of an RF source used in a UV system used for irradiating a substrate includes communicating data relating to the RF source from a monitor coupled to the RF source and to a controller. The method further includes storing a running total of actual operating time of the RF source in the database, to predict a remaining life of the RF source based on the running total of actual operating time of the RF source.

In some embodiments, a controller of the UV system includes an operating time database and stores data relating to the RF source, which may include a running total of actual operating time of the RF source. In this case, determining if the RF source is suitable for use with the UV system may include predicting a remaining life of the RF source based on the running total of actual operating time, and determining that the RF source is not suitable for use with the UV system if the RF source has no remaining life predicted. Additionally, the method may include indicating in the monitor that the RF source has no remaining life predicted in response to predicting that the RF source has no remaining life. The method may also include checking for the indication in the monitor, and determining that the RF source is not suitable for use with the UV system if the indicator is found.

In some embodiments, the data relating to the RF source includes an operating temperature of the RF source, and determining if the RF source is suitable for use with the UV system based on the data includes determining whether the operating temperature of the RF source is greater than a set maximum operating temperature. In response to determining that the operating temperature of the RF source is greater than the set maximum operating temperature, an over temp counter in the monitor is incremented, and a determination is made that the RF source is not suitable for use with the UV system if the over temp counter is greater than a set maximum value.

In some embodiments, the data relating to the RF source includes a high/low indicator, and determining if the RF source is suitable for use with the UV system based on the data includes determining if the RF source is in a proper combination of RF sources based on the high/low indicator.

It should be understood that the appended drawings are not necessarily to scale, presenting a somewhat simplified representation of various features illustrative of the basic principles of the invention. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

Furthermore, while the drawings and the following description will explain and illustrate the invention by reference to an RF source that is a magnetron, it should be understood that principles of the present invention are equally applicable to RF sources of the solid state type, or other RF sources that are usable in a UV system.

DETAILED DESCRIPTION

Figure 1:
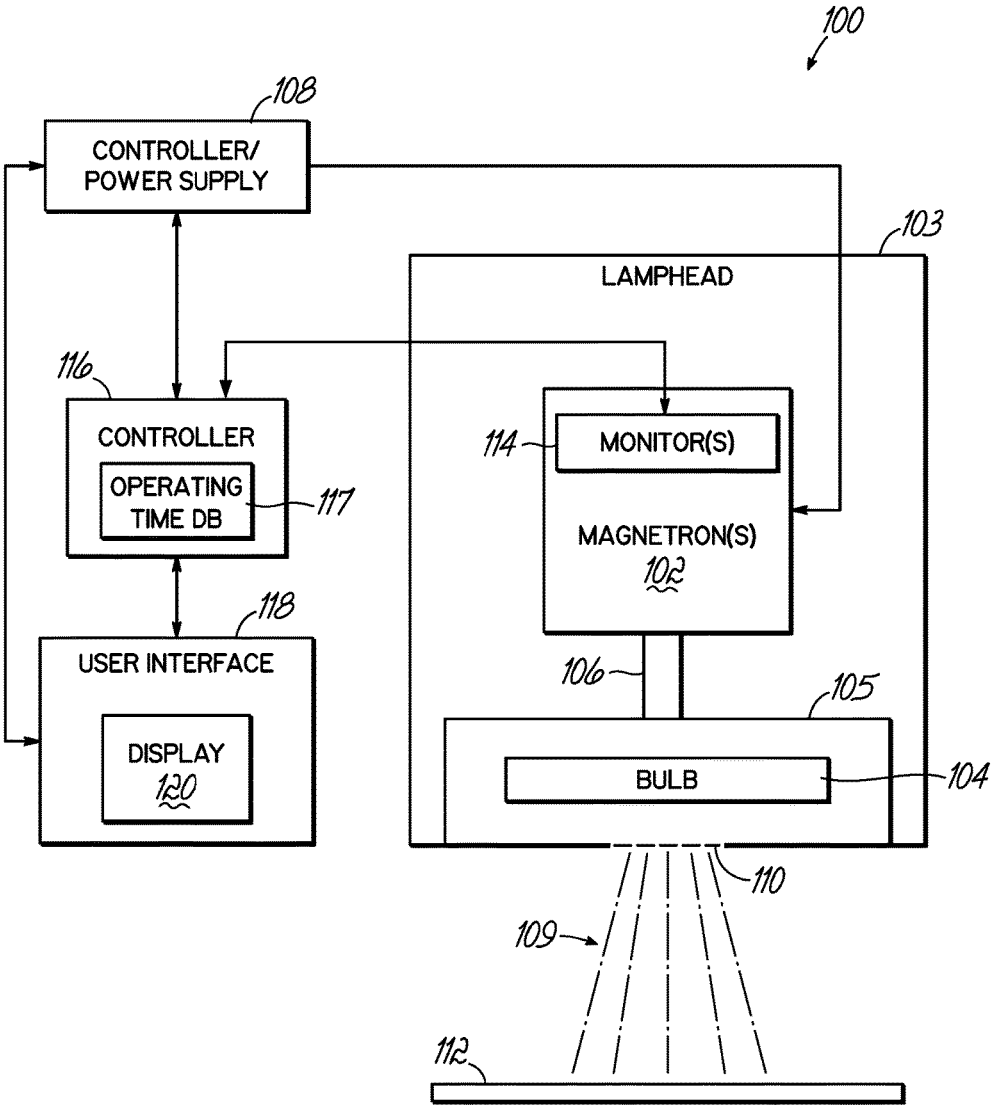
FIG. 1 is a schematic diagram of a UV system including one or more monitors coupled to one or more magnetrons.

FIG. 1 provides an exemplary UV system 100 that includes one or more magnetrons 102 enclosed in a lamphead 103. The magnetrons 102 are coupled to a UV bulb 104 in a microwave chamber 105 via one or more waveguides 106. Each waveguide 106 is geometrically proportional to the frequency of the magnetron 102 that is coupled thereto. In this way, each waveguide is capable of directing the RF energy generated by a magnetron 102 to the UV bulb 104. Upon the application of power from a controller/power supply 108, the magnetrons 102 generate RF energy that is directed, by the waveguides 106, to the UV bulb 104. The RF energy excites and ignites the UV bulb 104, thereby causing the UV bulb 104 to emit UV energy 109. The UV energy 109 is directed through a fine mesh metal screen 110 towards a substrate 112. The fine mesh metal screen 110 is capable of allowing UV energy 109 out of the lamphead 103 while preventing RF energy from doing the same.

As previously described, installation and use of an unsuitable magnetron 102 in the UV system 100 may result in suboptimal UV energy production and/or physical damage. To avoid these issues, the UV system 100 further includes one or more monitors 114 coupled to the magnetrons 102. Each monitor 114 includes a processor and a memory, and facilitates identification of the magnetron 102 coupled thereto, thereby ensuring that the magnetron 102 meets the stringent requirements of the UV system 100 and is fully compatible therewith. Moreover, each monitor 114 is capable of recording data relating to the operation of the magnetron 102 coupled thereto. Such data can be used to accurately predict the remaining life of each magnetron 102, as well as to alert a user of dangerous operating conditions and/or shut down the UV system 100. In this way, the life of the magnetron 102 may be prolonged, and aggressive or premature magnetron replacement schedules may be avoided. Additional details of these features of the monitors 114 are described in more detail below.

In one embodiment, each magnetron 102 has one or more monitors 114 coupled thereto. Alternatively, two or more of the magnetrons 102 may be coupled to the same one or more monitors 114.

The monitors 114 are coupled to a controller 116, which is capable of communicating with the monitors 114 via wires or wirelessly, and also of processing data received from the monitors 114. To that end, the controller 116 also includes a processor and a memory. Although the controller 116 is illustrated as being outside the lamphead 103 in FIG. 1, it may also be located therein. The controller 116 is coupled to the controller/power supply 108 and a user interface 118. Upon processing the data received from the monitors 114, the controller 116 is capable of generating and sending a corresponding signal to either of the coupled devices. Upon receiving the signal, each of the controller/power supply 108 and user interface 118 is capable of taking an appropriate action based on the information in the received signal, which is described in more detail below.

Although FIG. 1 illustrates the controller 116, controller/power supply 108, user interface 118, and monitors 114 as separate devices or modules, two or more of these items may be incorporated into the same device. For example, the monitors 114 and controller 116 may be incorporated into one device, and/or the controller 116, controller/power supply 108, and/or user interface 118 may be incorporated into one device. Similarly, the functions of the monitors 114 and controller 116 may be implemented by one device, and/or the functions of the controller 116, controller/power supply 108, and/or user interface 118 may be implemented by one device. Given the many possible combinations, those skilled in the art will recognize other suitable configurations and combinations for the items of FIG. 1 that are within the scope of the embodiments described herein.

In some embodiments, the monitors 114 facilitate predicting the remaining life of a magnetron 102 by measuring the operating temperature of the magnetron 102 from the magnetron's frame or fin, which is described in more detail below. Operating the magnetron 102 at a temperature higher than its rated operated temperature reduces the life of the magnetron. Accordingly, monitoring the operating temperature of a magnetron 102 helps the UV system 100 predict the remaining life of the magnetron 102 with increased accuracy, which enables manufactures to avoid overly aggressive or premature replacement schedules. Typically, manufacturers rate magnetrons 102 to operate at temperatures relative to the frame or fin of the magnetron 102. Hence, in this embodiment, the monitors 114 are coupled to the frame or fin of the magnetron 102. Although the frame of the magnetron 102 provides the monitors 114 with adequate temperature measurements for accurately determining the current operating temperature of the magnetron 102, the fin of the magnetron 102 may be used to provide a faster response time relative to detecting changes in the operating temperature of the magnetron 102, as the fin is closer to the heat source of the magnetron 102.

In some embodiments, the controller 116 and/or monitor 114 has encoded therein a maximum operating temperature. During operation of the UV system 100, the monitors 114 periodically detect the operating temperature of the magnetrons 102 and may send data relating to such detected operating temperature to the controller 116. In one exemplary embodiment, these detections are performed upon power up of the UV system 100 and every 10 seconds thereafter. If the monitor 114 and/or controller 116 detects that the magnetron 102 is operating at a temperature greater than the set maximum operating temperature, which is referred to herein as an extreme operating temperature condition, the controller 116 and/or monitor 114 may increment a counter stored therein. Once an extreme operation temperature condition is detected, or alternatively the counter reaches a set maximum value, the controller 116 generates and sends a corresponding signal to the controller/power supply 108 and/or user interface 118. In this way, appropriate action may then be taken to remove the extreme operating temperature condition, and thereby prolong the life of the magnetron 102 and prevent physical damage to the UV system 100.

In one exemplary embodiment, the controller 116 sends the corresponding signal to the controller/power supply 108, which shuts down the UV system 100, prevents the magnetron 102 from operating, and/or reduces power to the magnetron 102. Alternatively and/or in addition, the controller 116 may send the corresponding signal to the user interface 118. The user interface 118 includes a display 120, which is capable of presenting an error message regarding the extreme operating temperature condition. The UV system 100 may also include a cooling device (not shown), which is capable of cooling the contents of the lamphead 103. An indication of an extreme operating temperature condition may also cause the controller 116 to generate and send a corresponding signal to the cooling device and/or to the controller/power supply 108 to cause the cooling device to begin or increase cooling of the lamphead 103.

In addition to storing a counter relating to the number of times an extreme operating temperature condition has been detected, the controller 116 and/or monitor 114 may also store the specific operating temperatures that caused the detection of an extreme operating temperature condition. The stored counter and/or temperature information may be used for warranty evaluation purposes as well as predicting the remaining life of the magnetron 102.

The monitors 114 and/or controller 116 are also capable of recording the running total of actual operating time of a magnetron 102 to further facilitate predicting the remaining life thereof. In some embodiments, the monitors 114 and/or controller 116 record the operating time of magnetron 102 in 250 hour increments. Alternatively, the operating time of the magnetron 102 may be stored in 100 hour increments.

In one embodiment, as the actual operating time of a magnetron 102 is updated, the actual operating time of the magnetron 102 is exchanged between the monitors 114 and the controller 116 and stored on each. For example, the controller 116 may be coupled to a magnetron usage timer, which is capable of detecting when the UV system 100 is in a "Lamp on" state or a "Lamp Off" state. In this example, the controller 116 sends data to the monitors 114 representing the actual operating time of the magnetron 102, and this data is then stored on the monitors 114.

Furthermore, the controller 116 may be capable of storing the running total of actual operating time for a magnetron 102 in an operating time database 117, which is coupled thereto or included therein. In some embodiments, the controller 116 stores the running total of actual operating time of more than one magnetron 102 in the operating time database 117, which is described in more detail below.

In some embodiments, the controller 116 predicts the remaining life of the magnetron 102 based on the running total of actual operating time of the magnetron 102 stored in the operating time database 117 and/or the monitors 114. In addition to operating time, the controller 116 may also base the prediction of remaining life based on the extreme temperature detection counter and, if available, the associated temperatures stored therein or in the monitors 114.

Operating a magnetron 102 on the cusp of failure may damage the UV system 100 and/or adversely affect an irradiation process, as well as cause additional unexpected down time while replacing the magnetron 102. To avoid these problems from occurring, in one exemplary embodiment, once the magnetron has been operating for a number of pre-specified hours, for example in the range from 10,000 to 12,000 hours, the controller 116 generates and sends a corresponding signal to the user interface 118, which displays an error message that the magnetron 102 must be replaced or is close to needing to be replaced, depending on where in the range the running total of actual operating time falls. In addition or alternatively, the controller 116 may generate and send a corresponding signal to the controller/power supply 108, which prevents the magnetron 102 from operating. In this situation, the controller 116 may prevent the UV system 100 from operating until the relevant magnetron 102 is replaced with one that is suitable with the requirements of the UV system 100, thereby ensuring that the UV system 100 is not operated under dangerous conditions caused by using a failing or incompatible magnetron 102, and/or that the UV system 100 will not fail in the middle of an irradiation process.

In some embodiments, once the controller 116 predicts that a magnetron 102 has no remaining life left and therefore should be replaced, an indication that the magnetron 102 has no remaining life predicted is stored within the one or more monitors 114 coupled thereto. For example, the indication may be stored in the monitors 114 by setting a "used" bit from '0' to '1'. Additionally or alternatively, the indication that the particular magnetron 102 has no remaining life predicted may be stored in a database that is in the controller 116 or in communication with the controller 116, such as the operating time database 117. In either case, the database is considered to be coupled with the controller 116 for purposes herein. Thereafter, the controller 116 will prevent the magnetron 102 from operating and/or cause an error message to be displayed on the user interface 118 based on the stored indication.

In some embodiments, when a magnetron 102 is close to being at the end of its predicted life span (e.g., the predicted remaining life is 250 hours or less), the controller 116 also generates and sends a corresponding signal to the user interface 118 to display a message to that effect. Based on such information, a manufacturer may determine whether the magnetron 102 includes enough of a life span to finish an irradiation project, so as avoid a situation where the magnetron 102 fails in the middle of a project. In addition, if the manufacturer needs to acquire a replacement magnetron 102, the message reminds the manufacturer to do so before the current magnetron 102 fails.

The monitors 114 may also include identifying information relating to the magnetron 102 coupled thereto. The identifying information is used by the controller 116 to confirm the compatibility of the magnetron 102 and organize the operational data associated with the magnetron 102 in a database, such as the operating time database 117, including whether the magnetron 102 has no remaining life predicted, as described above. In addition, the identifying information may enable the controller 116 to ensure that a combination of magnetrons 102 used in the UV system 100 is safe and optimal (e.g., that the magnetrons 102 are constructed to generate RF energy with frequencies separated by 20 MHz).

In one embodiment, the monitors 114 include an identification code ("ID") and serial number encoded therein relating to the magnetron 102 coupled thereto. The ID is used by the controller 116 to determine that the coupled magnetron 102 is compatible with the UV system 100. The ID may be non-unique, thereby allowing the controller 116 to determine that that the coupled magnetron 102 is incompatible with the UV system based upon any variation in the stored ID. If so, then the controller 116 generates and sends a corresponding signal to the controller/power supply 108 and/or user interface 118, thereby causing each to prevent the magnetron 102 from being started and/or display an error message to a user, respectively. In this way, incompatible magnetrons 102 that are unsuitable for use with the UV system 100 are prevented from being operated within the UV system 100 or are at least warned of. Consequently, a user cannot or will not damage the UV system 100 by incorporating a magnetron 102 failing to meet the stringent requirements of the UV system 100, such as a magnetron 102 having an improper filament size or RF frequency output.

The serial number encoded in the monitors 114 identifies each specific magnetron 102 from other magnetrons 102 having the same ID (i.e., that are also compatible with the UV system 100). To that end, the serial numbers are unique, and the controller 116 may organize data relating to the operation of a magnetron 102 in a database, such as the operating time database 117, by the magnetron's serial number. For example, when the controller 116 determines that no remaining life for a magnetron 102 is predicted to exist, the controller 116 may store an indication of this determination with the serial number of the magnetron 102 in operating time database 117. Thus, the ID stored in a monitor 114 identifies the type or compatibility of magnetron 102 coupled thereto, and the unique serial number identifies the specific magnetron 102. Alternatively, the monitor 114 may only store the unique serial number, which is then used by the controller 116 both for organization and for confirming the compatibility of the magnetron 102 (with a lookup table, for example).

In some embodiments, the monitors 114 may also include a high/low indicator therein that relates to the magnetron 102 coupled thereto. As previously described, to ensure optimal operation of the UV system 100 and prevent damage caused by interference between two or more magnetrons 102 operating concurrently, the magnetrons 102 of the UV system 100 may be constructed so as to generate RF energy at different frequencies, such as at frequencies differing by 20 MHz. For example, the UV system 100 may be intended for use with a "high" magnetron 102 and a "low" magnetron 102, the high magnetron 102 generating RF energy at a frequency that is higher, such as by 20 MHz, than the frequency of the RF energy generated by the low magnetron 102. In this situation, the high/low indicator of each monitor 114 indicates whether the magnetron 102 coupled thereto is a high magnetron 102 or a low magnetron 102.

The controller 116 is capable of reading the high/low indicator from the monitors 114 of currently installed magnetrons 102 to ensure that the currently installed magnetrons 102 amount to a proper combination. For example, if a high magnetron 102 and a low magnetron 102 are installed, the controller 116 may be configured to consider the magnetrons 102 as being in a proper combination. Conversely, if two high magnetrons 102 or two low magnetrons 102 are installed, the controller 116 may be configured to consider the magnetrons 102 as being in an improper combination, and therefore as being unsuitable for use with the UV system 100. If the controller 116 determines that the currently installed magnetrons 102 includes an improper combination, the controller 116 may prevent the UV system 100 from operating and/or cause an appropriate error message to be displayed via the user interface 118, thereby avoiding or reducing the potential for damage caused by utilizing an improper combination of magnetrons 102 in the UV system 100.

Figure 2:
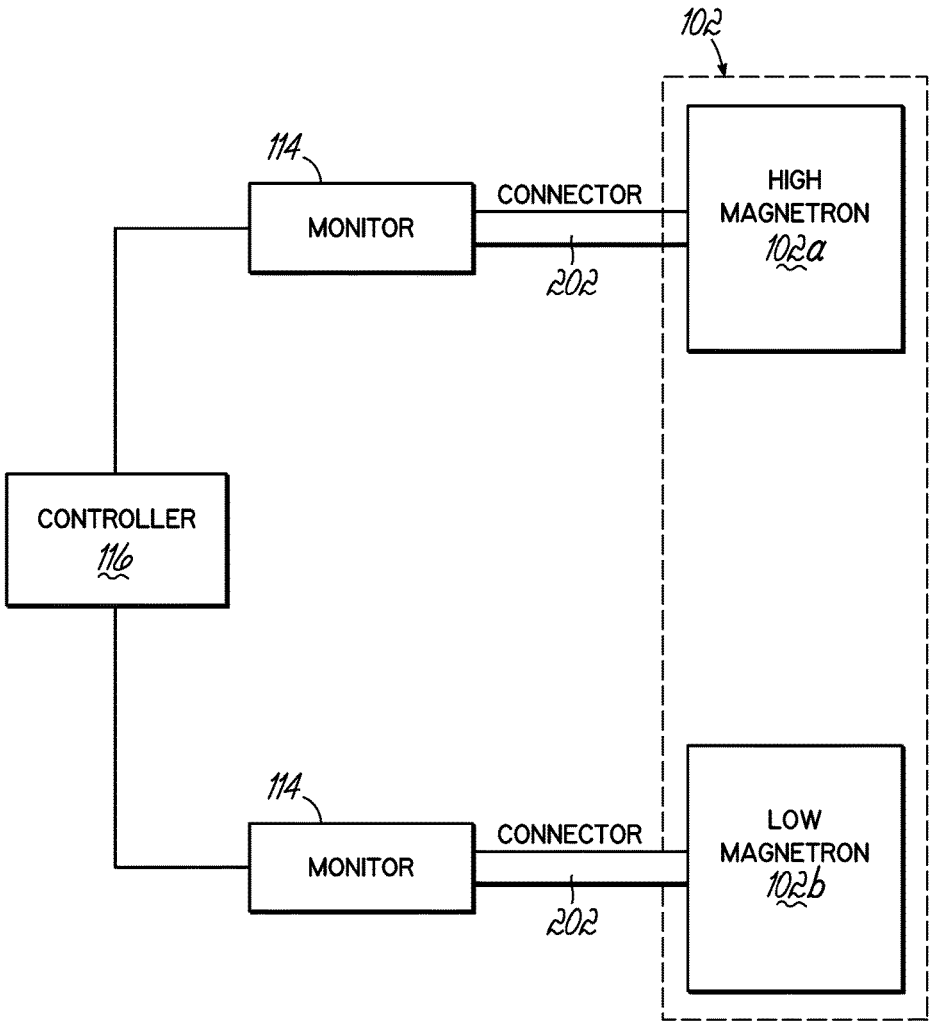
FIG. 2 is a schematic diagram of the coupling between two monitors and two magnetrons in a UV system.

FIG. 2 illustrates a coupling between the monitors 114 and the magnetrons 102. In particular, the magnetrons 102 include a high magnetron 102*a* and a low magnetron 102*b*. As previously described, the high magnetron 102*a* is constructed so as to generate RF energy at a frequency that is higher, such as by 20 MHz, than the RF energy generated by the low magnetron 102*b*. In a specific embodiment, for example, the high magnetron 102*a* may be constructed so as to generate RF energy at 2.47 GHz, and the low magnetron 102*b* may be constructed so as to generate RF energy at 2.45 GHz. Each of the high magnetron 102*a* and the low magnetron 102*b* are coupled to a monitor 114, which contains identification and/or operational data specific to the magnetron 102 that is coupled thereto, via a connector 202. The monitors 114 are coupled to the controller 116, which is capable of processing the operational and identification data as described above.

The monitor 114 may be positioned near and/or be thermally coupled to a mechanical connector device 202 (hereafter referred to as connector 202), and thus may be able to receive temperature data for the magnetron 102 through the connector 202. In this way, the monitor 114 is able to facilitate the detection of extreme operating temperature conditions and/or facilitate predicting remaining magnetron life with increased accuracy based on the operating temperature of the magnetron 102.

Figure 3:
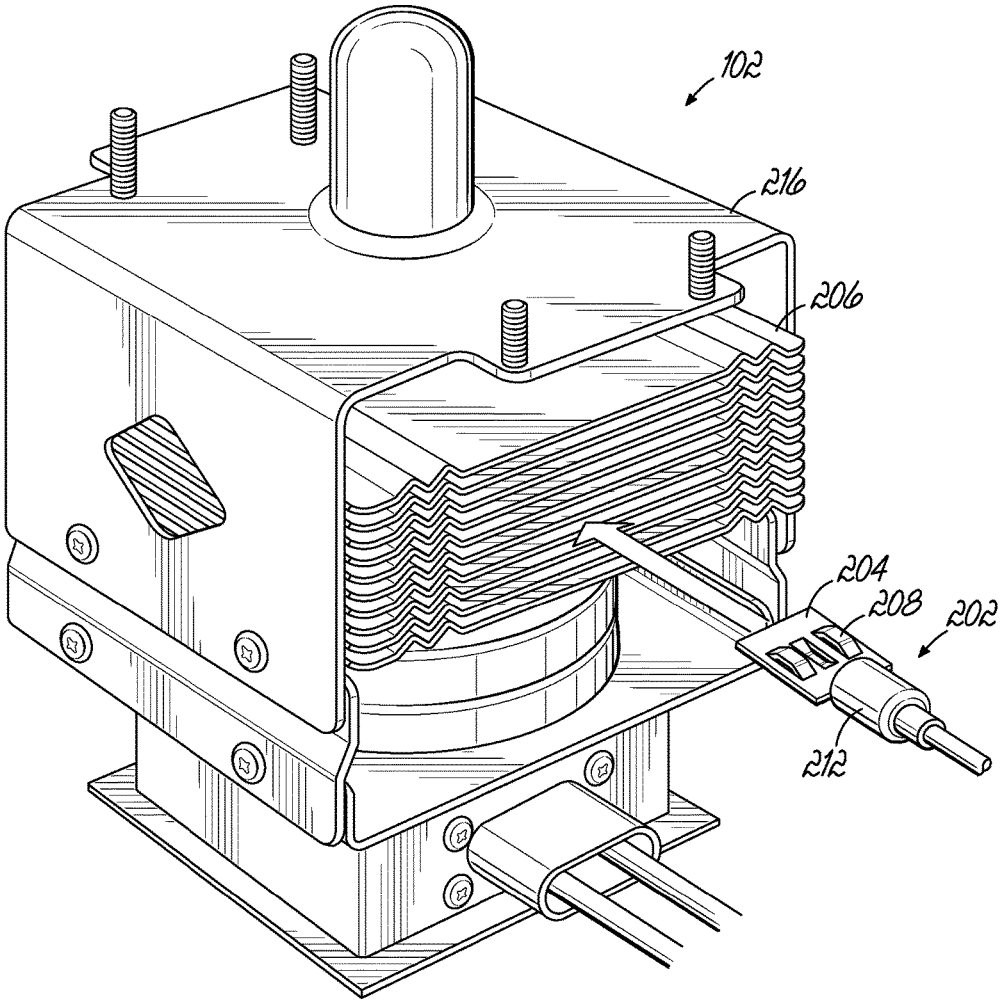
FIG. 3 is an isometric view of a magnetron and a connector for coupling the monitor to the magnetron.

Referring to FIG. 3, in one embodiment, the connector 202 containing the monitor 114 (See FIG. 4) includes a flat portion (or tab) 204 adapted to slide between two fins 206 of the magnetron 102. The flat portion 204 may include one or more flexible portions 208 that protrude from the flat portion 204, such as on each side of the flat portion 204, and that are adapted to flex towards the flat portion 204. In this way, when the flat portion 204 is slid between the fins 206, the fins 206 bias the flexible portions 208 towards the flat portion 204, which creates a frictional force between the connector 202 and the fins 206. The frictional force helps secure the connector 202 between the fins 206. Moreover, the flexible portions 208 enable the connector 202 to vary in width, and thereby allow the connector 202 to be placed between fins 206 of varying distances.

Figure 4:
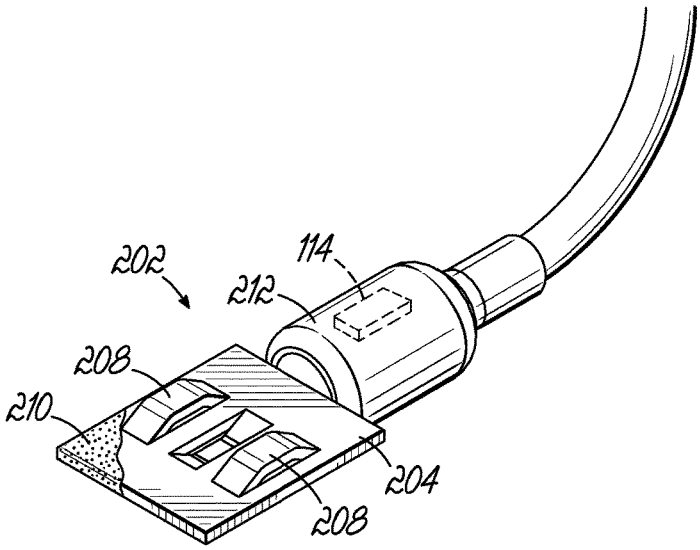
FIG. 4 is an isometric view of the connector and the monitor.

Referring to FIG. 4, in one embodiment, the flat portion 204 is sprayed with a conductive coating 210 and is thermally coupled to the monitor 114. In this way, when the flat portion 204 is slid between the fins 206 of the magnetron 102, the monitor is able to detect the operating temperature of the magnetron 102 through the flat portion 204, and thereby facilitate the detection of extreme operating temperature conditions. Also in the illustrated embodiment, a heat shrink 212 is placed around the monitor 114. The heat shrink 212 provides a three hundred sixty degree RF shield around the monitor 114. The environment in and around the magnetron 102 can be noisy from an RF standpoint due to the high power involved and a large RF pulse that typically occurs upon starting the magnetron 102. Such an environment may interfere the monitor's 114 ability to communicate with the controller 116, especially when wireless communication is implemented therebetween. The heat shrink 212 shields the monitor 114 from the noisy RF environment, and thereby reduces interference with the communications between the monitor 114 and the controller 116.

Figure 5:
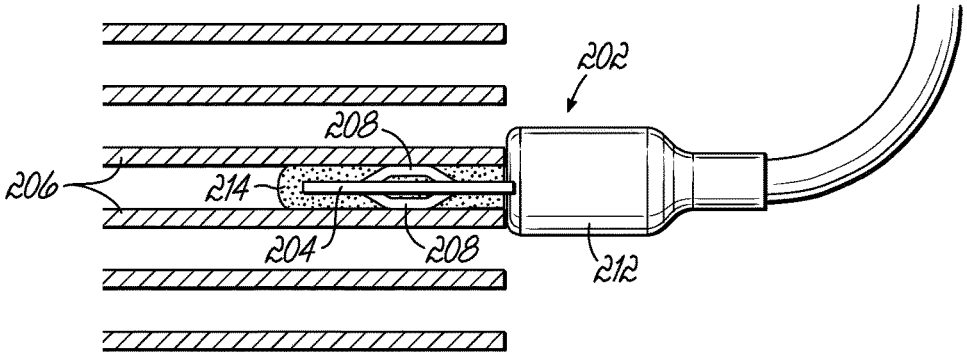
FIG. 5 is cross-sectional view of a coupling between the magnetron and the connector.

Referring to FIG. 5, in some embodiments, the connector 202 is rigidly coupled to one or more of the fins 206 of the magnetron 102, meaning that the connector 202 is not easily removable from the magnetron 102 without damaging the connector 202 and/or the monitor 114. The connector 202 may be rigidly coupled to the one or more fins 206 via any adhesive 214 that, when placed between the flat portion 204 and the one or more fins 206, is capable of permanently securing the flat portion 204 to the one or more fins 206 without significantly interfering with the monitor's 114 ability to detect the magnetron's 102 operating temperature. In one example, the adhesive 214 may include or consist of an epoxy.

When the connector 202 is rigidly coupled to the magnetron 102, it becomes difficult if not impossible to uncouple the monitor 114 from the magnetron 102 without damaging the monitor 114. This helps prevent monitors 114 from being uncoupled from one magnetron 102 and moved to another magnetron 102, such as a magnetron 102 that fails to be suitable for use with the UV system 100 (e.g., an incompatible magnetron 102, a magnetron 102 that results in an improper combination of magnetrons 102, a magnetron 102 with no remaining life predicted, etc.). Consequently, the rigid coupling helps prevent a user from misusing the UV system 100 when an incompatible magnetron 102 is installed. Similarly, the rigid coupling also helps prevent a user from misusing the UV system 100 by installing an improper combination of magnetrons 102, and/or by arranging a circumstance in which a failed or old magnetron 102 has additional remaining life. As described above, all of these conditions may result in physical damage to the UV system 100 and/or suboptimal UV production.

Moreover, even if a user is able to remove a connector 202 from a magnetron 102 without damaging the monitor 114, the controller 116 may be able to detect that the connector 202 has been moved via the temperature values returned from the magnetron 102. More particularly, if the connector 202 is uncoupled from one magnetron 102 and thereafter coupled to another magnetron 102, and the coupling locations of the connector 202 with each of the magnetrons 102 are not the same or very similar, the temperatures detected by monitor 114 from the new magnetron 102 will be uncharacteristic, thereby allowing the controller 116 to determine that the monitor 114 has been tampered with. In response, the controller 116 may perform one of the actions described above (e.g., indicating the serial number has no remaining life, displaying a message, preventing the magnetron from being started, etc.)

In alternative embodiments, the connector 202 includes a lug riveted to a specific location of a fin 206 of the magnetron 102, with or without the adhesive 214. In yet another embodiment, the connector 202 includes a clip that is secured to a specific location of a fin 206 of the magnetron 102, with or without the adhesive 214.

In alternative embodiments, the connector 202 may be of a specialized form or shape so that it will not integrate with incompatible magnetrons 102. In such a case, the monitor 114 may be incorporated elsewhere, such as at or near the controller 116. In addition or alternatively, a specialized connector 202 may be used to couple the monitor 114 to the controller 116. In some embodiments, other hardware elements, such as thermocouples or thermistors and suitable control circuits may be used instead of or in addition to the monitor 114 and/or controller 116 to perform the functions thereof. Encryption of the data between the connector 202, monitor 114, and/or controller 116 may also be implemented by a number of known techniques, including techniques in either software or hardware such as private key encryption, a private key generated signature for the monitor serial number that is embedded with the serial number, and the like.

Given the many possible connector types and configurations, those skilled in the art will recognize several other suitable connectors 202 and configurations within the scope of the embodiments described herein. For example, the connector 202 may be part of the monitor 114 and/or facilitate a direct mounting of the monitor 114 to the magnetron 102, such as with the adhesive 214.

In some embodiments, rather than being coupled to the fins 206 of the magnetron 102, the connector 202 may be coupled to the frame 216 (FIG. 3) of the magnetron 102, such as via one of the above-described techniques. As previously described, manufactures typically rate the operating temperatures of magnetrons 102 relative to the fin 206 or the frame 216 of the magnetron 102. Hence, the fin 206 or the frame 216 may provide the most relevant temperature data for the determinations facilitated by the monitor 114, such as predicting remaining life and/or detecting extreme operating temperatures. However, because the fin 206 is usually closer to the heat source of the magnetron 102, use of the fin 206 to detect operating temperatures may provide a faster response time relative to detecting changes in the operating temperature of the magnetron 102.

Figure 6:
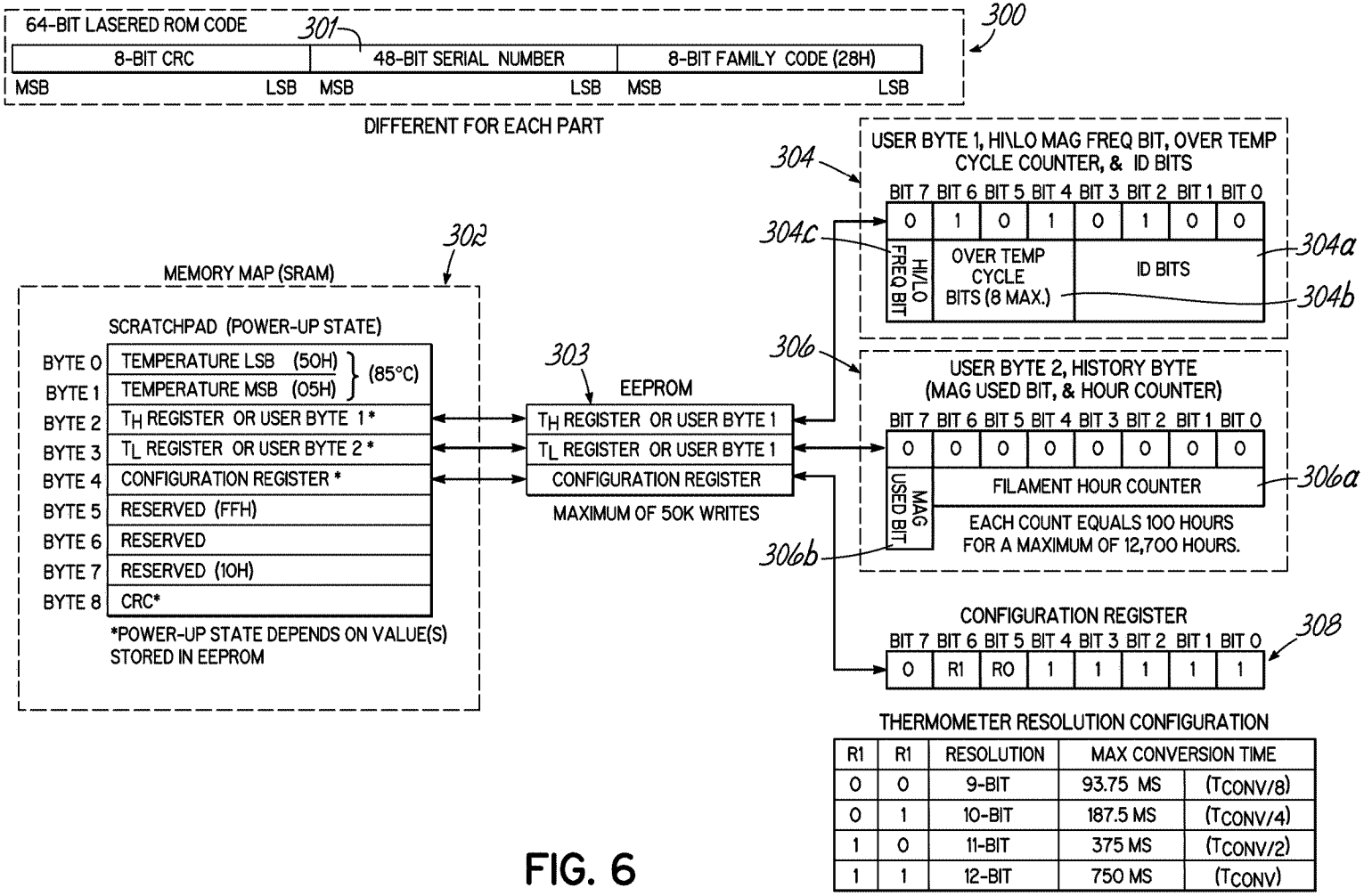
FIG. 6 is a schematic diagram of data in the monitor.

FIG. 6 illustrates data that may be stored in a monitor 114 to facilitate determining whether a magnetron 102 coupled thereto is suitable for use with the UV system 100, thereby ensuring that the UV system 100 operates in an optimal manner with a reduced risk of physical damage being caused by the magnetrons 102. More particularly, in the illustrated embodiment, the monitor 114 includes Read Only Memory ("ROM") 300, Static Random-Access Memory ("SRAM") 302, and Electrically Erasable Programmable Read-Only Memory ("EEPROM") 303.

In this example, the ROM 300 of monitor 114 includes the unique serial number 301 corresponding to a specific magnetron 102, as described above. The EEPROM 303 includes a number of data elements, including, for example, a non-volatile user byte 304, a non-volatile user byte 306, and a configuration register 308.

In the illustrated embodiment, the user byte 304 includes ID bits 304*a* that are representative of the ID of the magnetron 102 coupled to the monitor 114. As previously described, the controller 116 is able to read the ID bits 304*a* from the monitor 114 to determine whether the magnetron 102 is of a type that meets the stringent requirements for proper operation in the UV system 100.

In some exemplary embodiments, the user byte 304 further includes temperature bits 304*b* that represent the number of times the magnetron 102 coupled to the monitor 114 is found to be operating under an extreme operating temperature condition. In some embodiments, the controller 116 may be configured to display a warning or shut down the UV system 100 only if the magnetron 102 is found to be operating under an extreme operating temperature condition a set number of times and/or for a set amount of time (e.g., if the temperature bits 304*b* record that the magnetron 102 has been operating under an extreme operating temperature condition eight times, for eight seconds, etc.).

The user byte 304 may further include a high/low bit 304*c* that represents whether the magnetron coupled to the monitor 114 is a high magnetron 102*a* or a low magnetron 102*b*. For example, the high/low bit 304*c* having a value of '1' may indicate that the magnetron 102 coupled to the monitor 114 is a high magnetron 102*a*, and the high/low bit 304*c* having a value of '0' may indicate that the magnetron 102 is a low magnetron 102*b*. As described above, the high/low bit 304*c* may be read by the controller 116 to ensure that a proper combination of magnetrons 102 (e.g., one high magnetron 102*a* and one low magnetron 102*b*) is installed in the UV system 100.

In the illustrated embodiment, the user byte 306 includes hour counter bits 306*a* that represent the running total of actual operating time of the magnetron 102. The controller 116 may read the hour counter bits 306*a* to predict the remaining life of the magnetron 102 coupled to the monitor 114. The user byte 306 may further include a used bit 306*b*, and when the controller 116 predicts that the magnetron 102 has no remaining life, it may cause the used bit 306*b* to change from low to high.

In the illustrated embodiment, the EEPROM also includes a configuration register 308. The configuration register 308 may be set so as to configure the resolution or precision of the detected temperature.

The SRAM 302 reading from and writing to the EEPROM 303, as well as requesting and reading temperature measurements from the monitors 114, such as through bytes zero and one. In some embodiments, the EEPROM 303 may be capable of being rewritten only a certain number of times, such as 50,000 times, in which case each count in the hour counter bits 306*a* may represent multiple hours of operation of the magnetron 102. In this way, the monitor 114 is capable of storing the running total of actual operating time of the magnetron 102 up to a set maximum operating time without going past the writing limit.

Although FIG. 6 illustrates two non-volatile user bytes 304 and 306, those skilled in the art will recognize that the monitor 114 may include other non-volatile or volatile data elements and organizational structures, including additional bytes or bits, that are suitable and within the scope of the present embodiments. Moreover, the information stored and/or tracked in the monitor 114 may be represented by the bytes or bits thereof in any suitable manner, and is not limited to the particular arrangement described herein.

Figure 7:
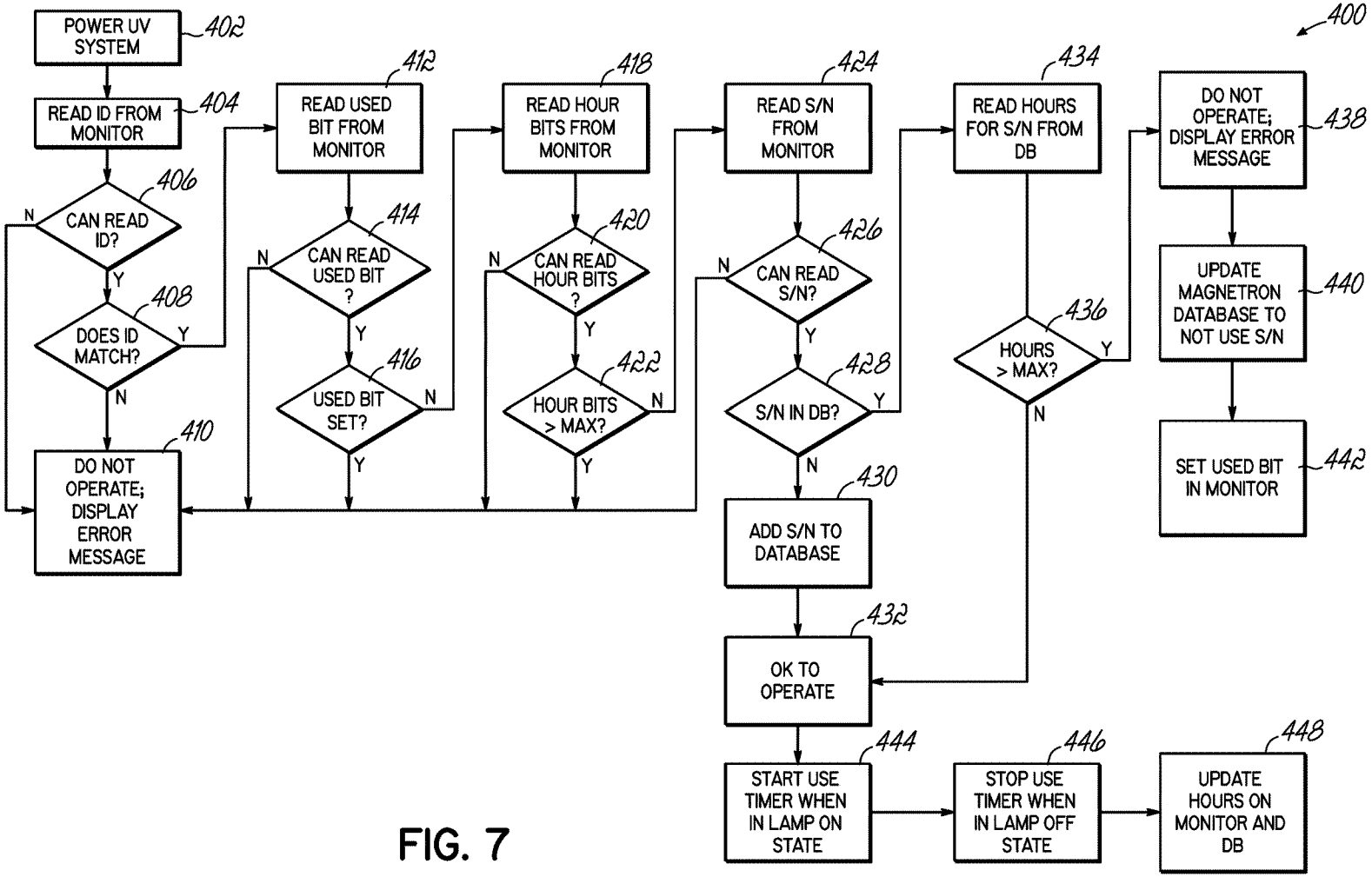
FIG. 7 is a flowchart for determining if the magnetron is suitable for use with the UV system.

FIG. 7 illustrates a flowchart 400 for determining whether a magnetron 102 is suitable for use with the UV system 100. The flowchart 400 may be implemented by a UV system, such as the UV system 100. More particularly, controller 116 of the UV system 100 may implement all or part of the flowchart 400 to ensure that the installed magnetrons 102 are safe for use with the UV system 100 and will facilitate providing an optimal amount of UV energy.

To begin, the UV system 100 is powered up (block 402), and the controller 116 reads the ID bits 304*a* from the monitor 114 coupled to the magnetron 102, such as from the user byte 304 (block 404). If the ID bits 304*a* cannot be read ("N" branch of block 406), or the ID bits 304*a* fail to indicate that the coupled magnetron 102 is compatible with the UV system 100 ("N" branch of block 408), then the controller 116 generates a corresponding signal to the controller/power supply 108 and/or user interface 118 to prevent the UV system 100 from being operated and/or generate an error message, respectively (block 410). For example, a template ID may be stored in or accessible by the controller 116, and the controller 116 may determine whether a magnetron 102 is compatible by comparing the ID bits 304*a* with the template ID. If the ID's match, then the magnetron 102 is considered compatible. Thus, If the ID bits 304*a* are readable ("Y" branch of block 406) and match the template ID ("Y" branch of block 408), thereby indicating that the coupled magnetron 102 is compatible with the UV system 100, then the controller may proceed to determine and/or predict whether the magnetron 102 has any remaining life.

In some embodiments, upon startup of the UV system 100, the controller 116 also queries each of the monitor 114 of each magnetron 102 to determine whether the installed magnetrons 102 are in a proper combination. In particular, the controller 116 may read the high/low bit 304*c* from the monitors 114, and thereby determine whether each of the magnetrons 102 coupled thereto is a high magnetron 102*a* or a low magnetron 102*b*. As previously described, utilizing two high magnetrons 102*a* or two low magnetrons 102*b* in the same UV system 100 may result in physical damage. Accordingly, if the controller 116 determines from the high/low bits 304*c* that that an improper combination of magnetrons 102 is installed, then under this embodiment the controller 116 generates a corresponding signal to the controller/power supply 108 and/or user interface 118 to prevent the UV system 100 from being operated and/or generate an error message, respectively.

After determining that a magnetron 102 is compatible with the UV system 100, the controller 116 determines whether the magnetron 102 has remaining life predicted. To this end, the controller 116 checks if an indication representing that the magnetron 102 has been fully used and should be replaced has been set, such as by reading the used bit 306*b* in the monitor 114 coupled to the magnetron 102 (block 412). If the used bit 306*b* cannot be read ("N" branch of block 414) or has been set ("Y" branch of block 416), then the controller 116 generates a corresponding signal to the controller/power supply 108 and/or user interface 118 to prevent the UV system 100 from being operated and/or generate an error message, respectively (block 410). Alternatively, if the used bit 306*b* can be read ("Y" branch of block 414) and has not been set ("N" branch of block 416), then the controller 116 may proceed to determine how much operational time is predicted to remain for the magnetron 102.

To make this determination, the controller 116 may read the running total of actual operating time already consumed by the magnetron 102 from the monitor 114, such as from the hour counter bits 306*a* (block 418). If the controller 116 is unable to read the actual operating time from the monitor 114 ("N" branch of block 420), or the actual operating time is greater than a set maximum operating time ("Y" branch of block 422), such as 12,000 hours for example, then the controller 116 generates a corresponding signal to the controller/power supply 108 and/or user interface 118 to prevent the UV system 100 from being operated and/or to generate an error message, respectively (block 410). However, if the actual operating time can be read from the monitor 114 ("Y" branch of block 420) and is less than or equal to the set maximum operating time ("N" branch of block 422), then the controller 116 may proceed to read the unique serial number 301 from the monitor 114, such as from the ROM 300 of the monitor 114 (block 424).

If the controller 116 is unable to read the unique serial number 301 from the monitor 114 ("N" branch of block 426), then the controller 116 generates a corresponding signal to the controller/power supply 108 and/or user interface 118 to prevent the UV system 100 from being operated and/or to generate an error message, respectively (block 410). Alternatively, if the controller 116 is able to read the unique serial number 301 ("Y" branch of block 426), then the controller 116 determines whether the unique serial number 301 already exists in a database coupled to the controller 116, such as the operating time database 117 (block 428). If not ("N" branch of block 428), then the controller 116 adds the unique serial number 301 to the database (block 430), and generates a signal to the controller/power supply 108 and/or user interface 118 that the UV system 100 is okay to operate (block 432).

Conversely, if the controller 116 determines that the unique serial number 301 is already in the database ("Y" branch of block 428), then the controller 116 proceeds to check the running total of actual operating time recorded for that unique serial number 301 in the database (block 434). If more than a set maximum operating time has been recorded for the unique serial number 301 ("Y" branch of block 436), such as more than 12,000 hours, the controller 116 generates a corresponding signal to the controller/power supply 108 and/or user interface 118 to prevent the UV system 100 from being operated and/or generate an error message, respectively (block 438). The controller 116 also updates the database to indicate that the magnetron 102 corresponding to unique serial number 301 has no predicted remaining life left (block 440), and indicates the same in the monitor 114, such as by setting the used bit 306*b* (block 442). However, if less than the set maximum operating time has been recorded in the database for the unique serial number 601 ("N" block of 436), then the controller 116 generates a corresponding signal to the controller/power supply 108 and/or user interface 118 that the UV system 100 is okay to operate (block 432).

After the controller 116 generates the signal that the UV system 100 is okay to operate (block 432), the controller 116 starts a magnetron usage timer when the UV system 100 becomes operational and is in a "Lamp On" state (block 444). Thereafter, when the UV system enters a "Lamp Off" state, the controller 116 stops the magnetron usage timer (block 446). The controller 116 then updates the running total of actual operating time in the monitor 114, such as by incrementing the hour counter bits 306*a* for every 100 hours of magnetron operation, and/or updates the running total of actual operating time associated with the unique serial number 301 within the database coupled to the controller 116 (block 448).

Figure 8:
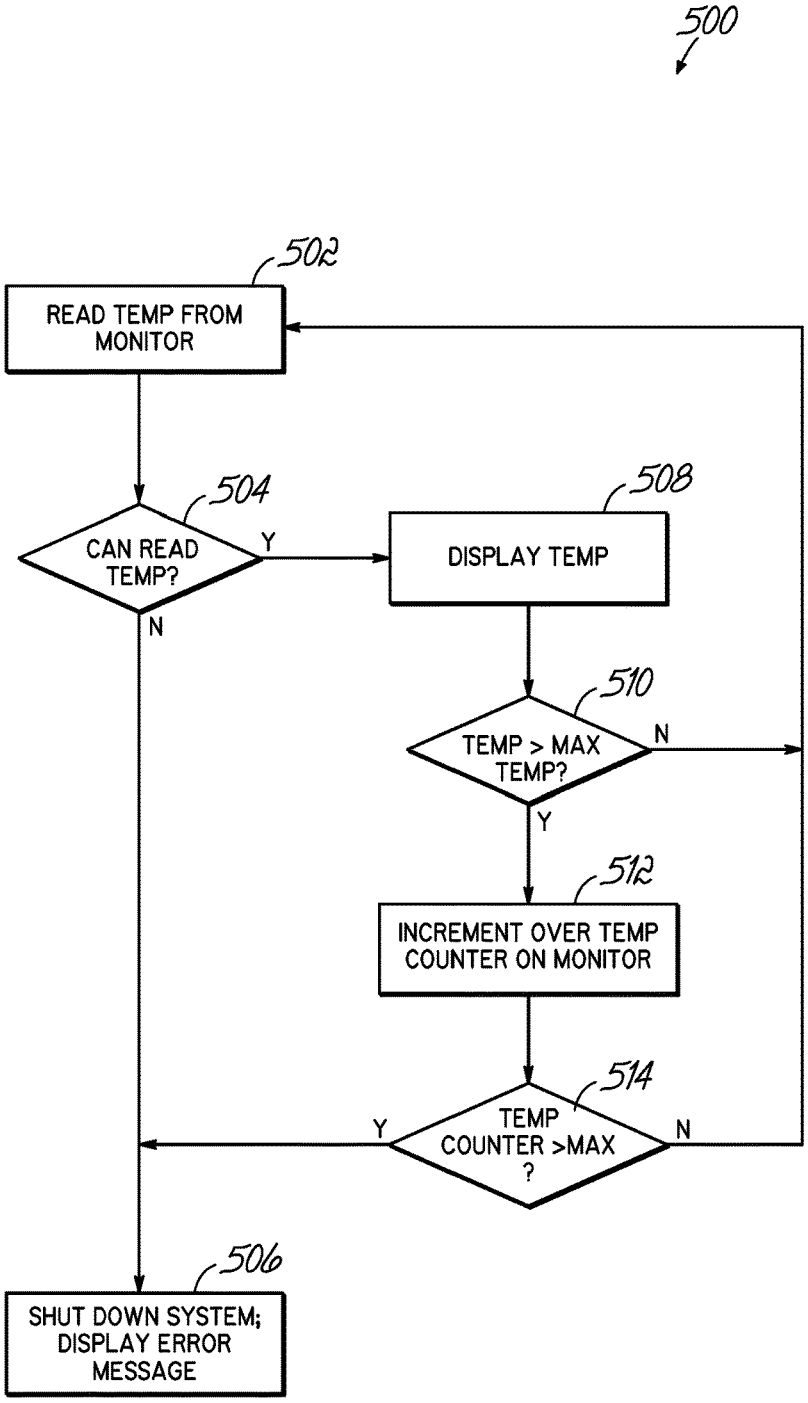
FIG. 8 is another flowchart for determining if the magnetron is suitable for use with the UV system.

FIG. 8 illustrates another flowchart 500 for determining whether a magnetron 102 is suitable for use with the UV system 100. The flowchart 500 may similarly be implemented by a UV system, such as the UV system 100. More particularly, the controller 116 of the UV system 100 may implement all or part of the flowchart 500 to ensure that the installed magnetrons 102 are operating safely in the UV system 100 and are facilitating providing an optimal amount of UV energy.

To begin, when the UV system 100 is operational, the controller 116 reads operating temperatures of the magnetron 102, such as via the monitor 114 (block 502). For example, temperatures may be read from the monitor 114 upon startup and then periodically every 10 seconds, and be compared with a set maximum operating temperature stored in the controller 116, such as 70° C. If the operating temperature of the magnetron 102 cannot be read ("N" branch of block 504), then the controller 116 generates a corresponding signal to the controller/power supply 108 and/or user interface 118 to prevent the UV system 100 from being operated and/or generate an error message, respectively (block 506). Alternatively, if the operating temperature can be read ("Y" branch of block 504), then the current operating temperature may be displayed, such as via the user interface 118 (block 508).

The controller 116 then determines if the detected operating temperature is greater than the set maximum operating temperature stored therein (block 510). If the controller 116 determines that the detected operating temperature is less than or equal to the set maximum operating temperature ("N" branch of block 510), then the controller 116 continues monitoring the operating temperature of the magnetron 102 (block 502). However, if the controller 116 determines that the operating temperature is greater than the set maximum operating temperature ("Y" branch of block 510), then the controller 116 increments an over temperature counter in the monitor 114, such as via the temperature bits 304*b*. Thereafter, the controller 116 determines whether the over temperature counter has exceeded a set maximum value programmed therein (block 514). If so ("Y" branch of block 514), then the controller 116 generates a corresponding signal to the controller/power supply 108 to shut down the system and/or sends a corresponding signal to the user interface 118 to generate an error message (block 506). Conversely, if the controller 116 determines that the set maximum value has not been exceeded by the over temperature counter ("N" branch of block 514), then the controller 116 continues to monitor the operating temperature of the magnetron 102 (block 502).

The above-described temperature monitoring technique enables the UV system 100 to continue operating until an extreme operating temperature condition occurs a preprogrammed number of times, such as eight times. In this way, the UV system 100 is not shut down by an uncharacteristic or single temperature spike. In alternative embodiments, however, the controller 116 may be configured to shut down the UV system and/or cause generation of an error message whenever a magnetron 102 is determined to be in an extreme temperature operating condition. In other embodiments, the controller 116 may also take into account the value of the temperature that resulted in the detection of an extreme operating temperature condition. For example, the controller 116 may be programmed with a set temperature threshold that is higher than the set maximum operating temperature. The controller 116 may be configured to cause shut down of the UV system 100 and/or generation of an error message when the magnetron 102 is determined to be operating at a temperature between the maximum operating temperature and the set temperature threshold a high number times, and may be configured to cause shut down of the UV system 100 and/or generation of an error message when the magnetron 102 is determined to be operating at a temperature above the set temperature threshold a relatively lower number times. In this way, operating at higher unsafe temperatures is given more weight than operating at lower unsafe temperatures. In yet another embodiment, the controller 116 may be configured to cause generation of a warning when the temperature of a magnetron 102 is approaching the set maximum operating temperature.

As used herein, the term "coupled" is not meant to limit the medium in which two modules or devices are connected. Rather, "coupled" is used herein to mean capable of communicating with one another, whether physically or in terms of data and whether through an interim device or module or not. For example, "coupled" could refer to a physical connection or a wireless connection between two devices or modules with or without additional devices or modules therebetween. Furthermore, two devices or modules are considered "coupled" if one is implemented in another or able to access the other.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of applicants' general inventive concept.

What is claimed is:

1. A UV system for irradiating a substrate, the UV system comprising:

a RF source configured to generate RF energy;

a UV lamp configured to emit UV energy when excited by the RF energy generated by said RF source;

a monitor coupled to said RF source, said monitor comprising a first processor and a first memory configured to generate data relating to said RF source; and a controller configured to receive said data from said monitor, and determine whether said RF source is suitable for operation with said UV system based on said data, said controller comprising a second processor and a second memory that are different from the first processor and the first memory, wherein at least one of the monitor and the controller is configured to detect that an operating condition of the RF source exceeds a set maximum and to increment a count in response to the detection that the operating condition of the RF source exceeds the set maximum.

2. The UV system of claim 1, wherein said data includes an identification code specific to said RF source, and said controller is configured to determine whether said RF source is suitable for operation with said UV system by determining if said RF source is compatible with said UV system based on said identification code included in said data.

3. The UV system of claim 2, wherein the controller is configured to determine whether said RF source is suitable for operation with said UV system by determining if at least one of a filament size and a RF frequency output of said RF source is compatible with said UV system based on said identification code included in said data.

4. The UV system of claim 2, further comprising a connector coupling said monitor to said RF source such that said connector is not removable without damaging said connector and/or said monitor.

5. The UV system of claim 4, wherein said RF source is a magnetron which includes a cooling fin, and said monitor is coupled to said cooling fin by said connector.

6. The UV system of claim 4, wherein said RF source includes a frame, and said monitor is coupled to said frame of said RF source by said connector.

7. The UV system of claim 1, wherein said data includes an operating temperature of said RF source, and said controller is configured to determine whether said RF source is suitable for operation with said UV system based on said operating temperature.

8. The UV system of claim 7, wherein said controller is configured to determine that said RF source is not suitable for operation with said UV system if said operating temperature exceeds a set maximum operating temperature.

9. A UV system for irradiating a substrate, the UV system comprising:

a RF source configured to generate RF energy;

a UV lamp configured to emit UV energy when excited by the RF energy generated by said RF source;

a monitor coupled to said RF source, said monitor comprising a first processor and a first memory configured to generate data relating to said RF source; and a controller configured to receive said data from said monitor, and determine a useful remaining life of said RF source based on said data, said controller comprising a second processor and a second memory that are different from the first processor and the first memory, wherein at least one of the monitor and the controller is configured to detect that an operating condition of the RF source exceeds a set maximum and to increment a count in response to the detection that the operating condition of the RF source exceeds the set maximum.

10. The UV system of claim 9, wherein said controller is configured to store a running total of actual operating time of said RF source.

11. The UV system of claim 9, wherein said data includes a running total of actual operating time of said RF source, and said controller is configured to determine whether said RF source is suitable for operation with said UV system by predicting a remaining life of said RF source based on the running total of actual operating time of said RF source included in said data.

12. The UV system of claim 11, wherein said controller is configured to determine that said RF source is not suitable for operation with said UV system if said controller predicts that said RF source has no life remaining.

13. A method for determining whether a RF source is suitable for use in a UV system used for irradiating a substrate, the UV system comprising a monitor coupled to said RF source, the monitor comprising a first processor and a first memory configured to generate data relating to said RF source, the method comprising:

generating the data via the monitor of the UV system that is related to the RF source;

communicating the data relating to the RF source to a controller of the UV system comprising a second processor and a second memory that are different from the first processor and the first memory; and determining whether the RF source is suitable for use with the UV system based on the data by detecting that an operating condition of the RF source exceeds a set maximum and incrementing a count in response to the detection that the operating condition of the RF source exceeds the set maximum.

14. The method of claim 13, wherein the data relating to the RF source includes an identification code of the RF source.

15. The method of claim 13, further comprising:

generating an error signal if it is determined that the RF source is not suitable for use with the UV system; and preventing, in response to generation of the error signal, operation of the RF source.

16. The method of claim 13, further comprising:

generating an error signal if it is determined that the RF source is not suitable for use with the UV system; and displaying, in response to generation of the error signal, an error message on a user interface.

17. The method of claim 13, wherein the data relating to the RF source includes an operating temperature of the RF source, and determining whether the RF source is suitable for use with the UV system based on the data further comprises:

determining that the RF source is not suitable for use with the UV system if the operating temperature of the RF source is greater than a preset maximum operating temperature.

18. The method of claim 13, wherein determining whether the RF source is suitable for use with the UV system based on the data further comprises determining a useful remaining life of said RF source based on said data.

19. The method of claim 18, wherein the data relating to the RF source includes a running total of actual operating time of the RF source, and determining whether the RF source is suitable for use with the UV system based on the data further comprises:

predicting a remaining life for the RF source based on the running total of actual operating time; and determining that the RF source is not suitable for use with the UV system if the RF source has no remaining life predicted.

20. The method of claim 19, further comprising:

visually indicating that the RF source has no remaining life predicted in response to determining that the RF source is not suitable for use with the UV system.

21. The method of claim 18, wherein the data relating to the RF source includes an operating temperature of the RF source, and determining whether the RF source is suitable for use with the UV system based on the data further comprises:

determining whether the operating temperature of the RF source is greater than a preset maximum operating temperature.

22. The method of claim 21, wherein the incriminating of the count comprises incrementing, in response to determining that the operating temperature of the RF source is greater than the preset maximum operating temperature, an over temp counter.

23. The method of claim 22, further comprising determining that the RF source is not suitable for use with the UV system if the over temp counter is greater than a preset maximum value.

24. The method of claim 18, wherein the data relating to the RF source includes a high/low indicator, and determining if the RF source is suitable for use with the UV system based on the data further comprises:

determining whether the RF source is in a proper combination of RF sources based on the high/low indicator.

* * * * *